US006607370B2

(12) United States Patent
Fukamachi et al.

(10) Patent No.: US 6,607,370 B2
(45) Date of Patent: Aug. 19, 2003

(54) MAGNETIC PUMP

(75) Inventors: Masatoshi Fukamachi, Wako (JP); Osamu Sato, Kiryu (JP)

(73) Assignees: Honda Giken Kogyo Kabushiki Kaisha, Tokyo (JP); Kabushiki Kaisha Yamada Seisakusho, Gunma-Ken (JP)

( * ) Notice: Subject to any disclaimer, the term of this patent is extended or adjusted under 35 U.S.C. 154(b) by 0 days.

(21) Appl. No.: 09/983,772

(22) Filed: Oct. 25, 2001

(65) Prior Publication Data

US 2002/0054820 A1 May 9, 2002

(30) Foreign Application Priority Data

Nov. 6, 2000 (JP) ..... 2000-338393

(51) Int. Cl.[7] ..... F04B 17/00
(52) U.S. Cl. ..... 417/420; 417/423.14; 464/29
(58) Field of Search ..... 417/420, 423.1, 417/423.14; 464/29

(56) References Cited

U.S. PATENT DOCUMENTS 3,411,450 A * 11/1968 Clifton ..... 417/420
3,545,892 A * 12/1970 Zimmermann ..... 417/373
4,998,863 A * 3/1991 Klaus ..... 417/63
5,017,102 A * 5/1991 Shimaguchi et al. ..... 417/420
5,248,245 A * 9/1993 Behnke et al. ..... 417/366
5,779,456 A * 7/1998 Bowes et al. ..... 417/420
5,915,931 A * 6/1999 Lindner et al. ..... 417/420

FOREIGN PATENT DOCUMENTS

JP 3-32196 3/1991

* cited by examiner

*Primary Examiner*—Charles G. Freay
*Assistant Examiner*—Michael K. Gray
(74) *Attorney, Agent, or Firm*—Lowe Hauptman Gilman & Berner, LLP

(57) ABSTRACT

A magnetic pump having an internal magnet that is caused to rotate from outside its housing in order to cause rotation of the impeller. In a magnetic coupling structure in which an inner magnet disposed on an impeller is accommodated in a cylindrical accommodating portion of the housing, the outer circumferential surface of this accommodating portion is loosely inserted into the inner circumferential surface of a cylindrical outer magnet which is supported on its outer circumferential surface by a magnet cup body, and which rotates together with this magnet cup body, and the impeller rotates in accordance with the rotation of the outer magnet, and a cylindrical covering member which covers the inner circumferential surface of the abovementioned outer magnet is mounted on the outer magnet.

3 Claims, 4 Drawing Sheets

17
17b
17b1
17a1
15
15c
16
16a
15c
17a
15a
16b
15b

A1
1a
B
10a
2
12
A2
8
7
6
10a
4
1
7a
11
10
13
6b
6a
5

MAGNETIC PUMP

BACKGROUND OF THE INVENTION

1. Field of the Invention

The present invention relates to a magnetic pump in which an internal magnet is driven from the outside of the housing in order to cause the rotation of an impeller, and more particularly relates to improving the durability of the outer magnet of the pump.

2. Description of the Related Art

Conventionally, magnetic pumps have been widely used as engine cooling devices or lubricating devices in automobiles, motorcycles and the like. Generally, a magnetic pump has a magnetic coupling structure which is used to cause rotation of the impeller inside the pump housing. In such a magnetic coupling structure, the inner magnet of the impeller on which the inner magnet is mounted receives the magnetic force of an outer magnet which is appropriately disposed on the outside of the pump housing, so that this inner magnet is caused to rotate at a high speed as a result of the high-speed rotation of the outer magnet, thus causing the impeller to rotate.

In particular, in the case of magnetic pumps of the type in which [i] the inner magnet mounted on the impeller has a cylindrical shape, [ii] the outer magnet has a cylindrical shape, [iii] a cylindrical accommodating portion is formed in the pump housing, [iv] the inner magnet of the impeller is accommodated in said cylindrical accommodating portion, and [v] the outside surface of the abovementioned cylindrical accommodating portion is accommodated on the inner circumferential side of the cylindrical outer magnet, the area of the magnetic force exerted by the outer magnet on the inner magnet can be greatly increased, so that a magnetic pump which has a more powerful magnetic coupling can be obtained. The outer magnet is mounted on a holder, and said holder receives a rotational force from another driving source such as, for example, an engine, and rotates as a unit with the outer magnet.

A magnetic pump of this type is disclosed in Japanese Utility Model Laid-Open Application No. 3-32196. In this magnetic pump, the outer magnet is first of all devised as follows: specifically, a coupling main body made of a steel plate is fastened to the end portion (with respect to the axial direction) of the drive shaft. Groove-form engaging portions are formed in portions of a permanent magnet which is accommodated inside said coupling main body, and engaging portions which are formed by the buckling of portions of the coupling main body into said groove-form engaging portions are engaged with said groove-form engaging portions so that the coupling main body and permanent magnet are integrally fastened in the rotational direction and axial direction.

The outer circumferential side of the permanent magnet accommodated inside the coupling main body is covered and held by a coupling made of a steel plate, and is thus fastened in the rotational direction and axial direction. Accordingly, no problems arise in an ordinary environment. However, magnetic pumps are widely used as cooling water supply means or lubricating oil supply means in the engines of automobiles, motorcycles and the like, and in cases where such magnetic pumps are installed and used in engines, the use environment involves exposure to temperature changes or large temperature differences, such as when the temperature abruptly varies from a low temperature to a high temperature when the engine is started. Furthermore, such magnetic pumps are used under various harsh conditions such as severe vibration from the engine, vehicle body or the like.

The outer magnet and inner magnet constituting the magnetic coupling are generally made of brittle materials. Furthermore, magnets of this type are constantly used in the harsh environment described above.

As a result, the outer magnet in particular is subjected to the effects of abrupt temperature changes and severe vibration, and as a result of a synergistic effect of such conditions, there is a danger that looseness of the outer magnet may occur. Moreover, if the outer magnet should come loose from the magnet cup body, this results in a deterioration in the function of the pump.

SUMMARY OF THE INVENTION

Especially in the case of the outer magnet of the magnetic coupling which is thus exposed to a harsh environment, it is necessary to take countermeasures to prevent the abovementioned deterioration in function in cases where the magnetic pump is used in practical applications in engines or the like. An object of the present invention is to improve pump performance by preventing the separation of the outer magnet from the magnet cup body in harsh environments, such as the interiors of engines or the like.

Accordingly, the present inventor conducted diligent research in order to solve the above-mentioned problems. As a result, the inventor successfully prevented separation of the outer magnet from the magnet cup body even in cases where looseness was generated in the outer magnet, by constructing the present invention as a magnetic pump having a magnetic coupling structure in which an inner magnet disposed on an impeller is accommodated in a cylindrical accommodating portion of the housing, the outer circumferential surface of the accommodating portion is loosely inserted into the inner circumferential surface of a cylindrical outer magnet which is supported on its outer circumferential surface by a magnet cup body, and which rotates together with the magnet cup body, and the impeller rotates in accordance with the rotation of the outer magnet, wherein a cylindrical covering member which covers the inner circumferential surface of the outer magnet is mounted on the outer magnet.

DESCRIPTION OF THE PREFERRED EMBODIMENTS

Figure 1:
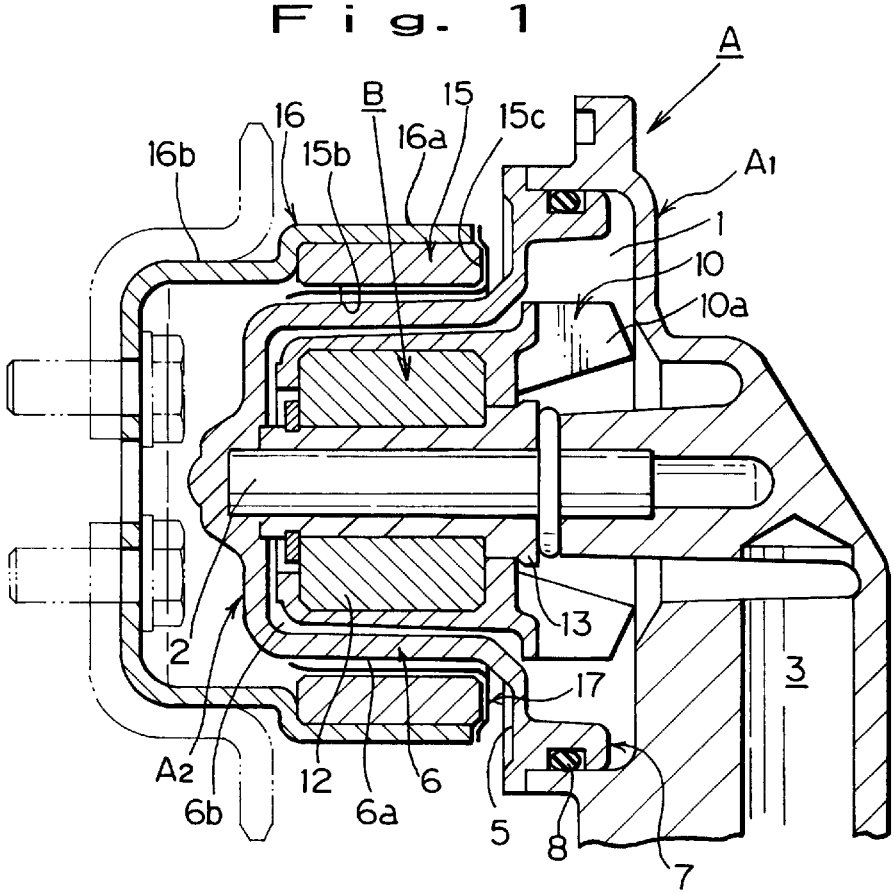
FIG. 1 is a longitudinal-sectional side view of a magnetic pump in which the present invention is installed.
Figure 2:
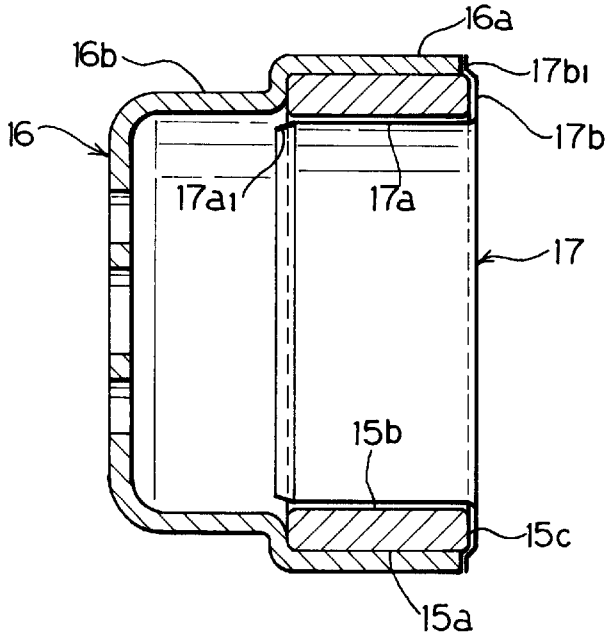
FIG. 2 is a sectional view of the magnet cup body and outer magnet.
Figure 3:
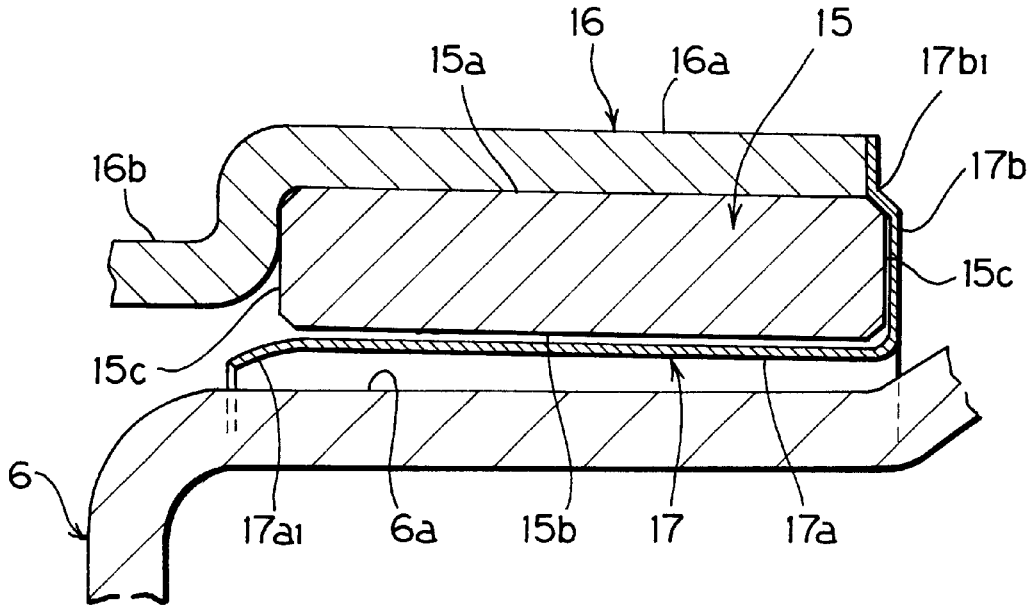
FIG. 3 is an enlarged sectional view of parts of the present invention.
Figures 5A, 5B:
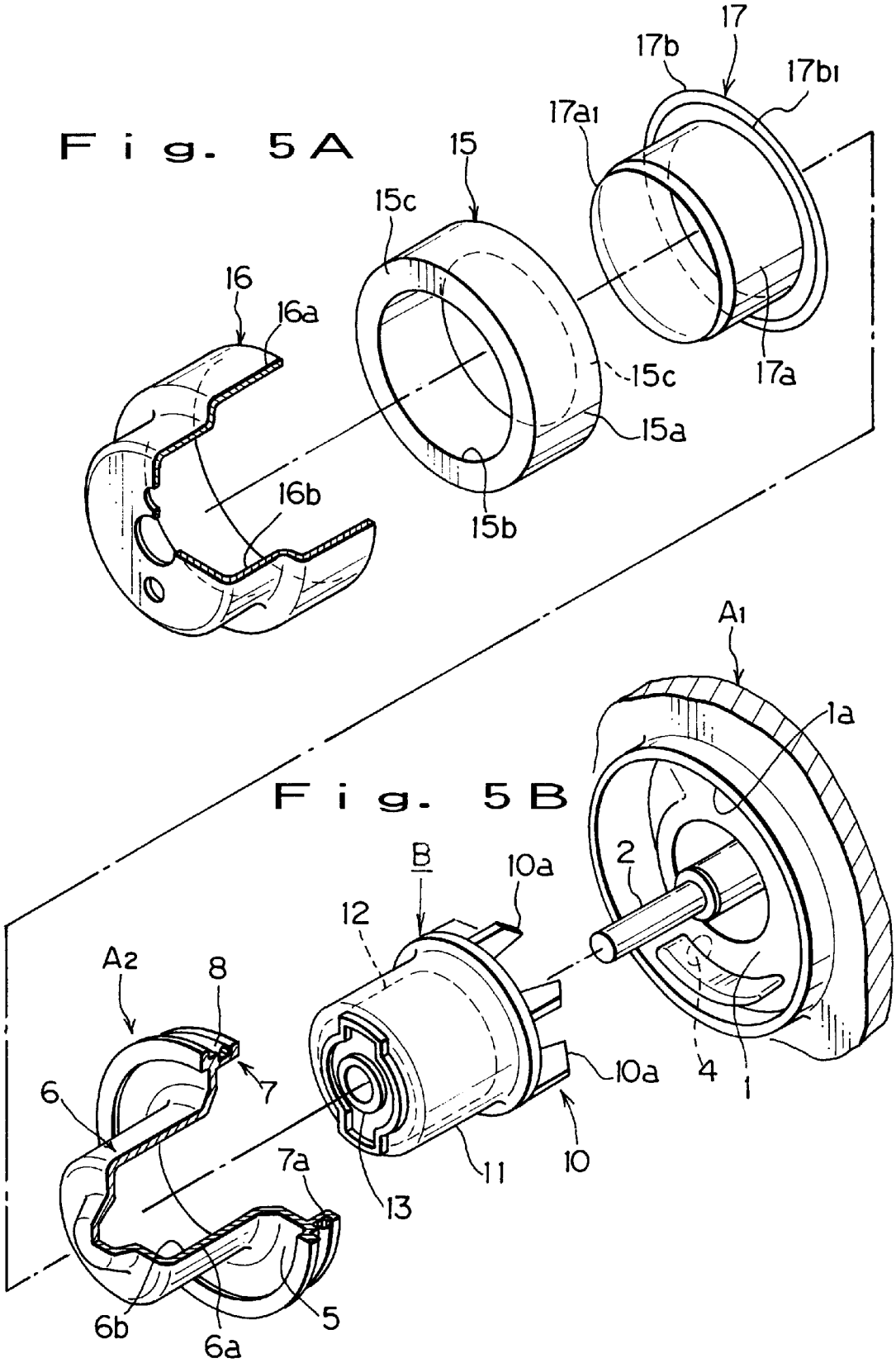
FIGS. 5A–5B together form an exploded perspective view of the magnetic pump.

Below, an embodiment of the present invention will be described with reference to the attached figures. First, to describe the construction of the magnetic pump, the pump housing A is constructed mainly from a housing main body portion $A_1$ and a coupling partition wall portion $A_2$. A substantially circular impeller chamber 1 is formed in this housing main body portion $A_1$, and an impeller supporting shaft 2 is disposed in a central position in the impeller chamber 1. Furthermore, an intake port 3 and a discharge port 4 are formed in the impeller chamber 1 (see FIG. 1 and FIGS. 5A–5B).

Figure 4:
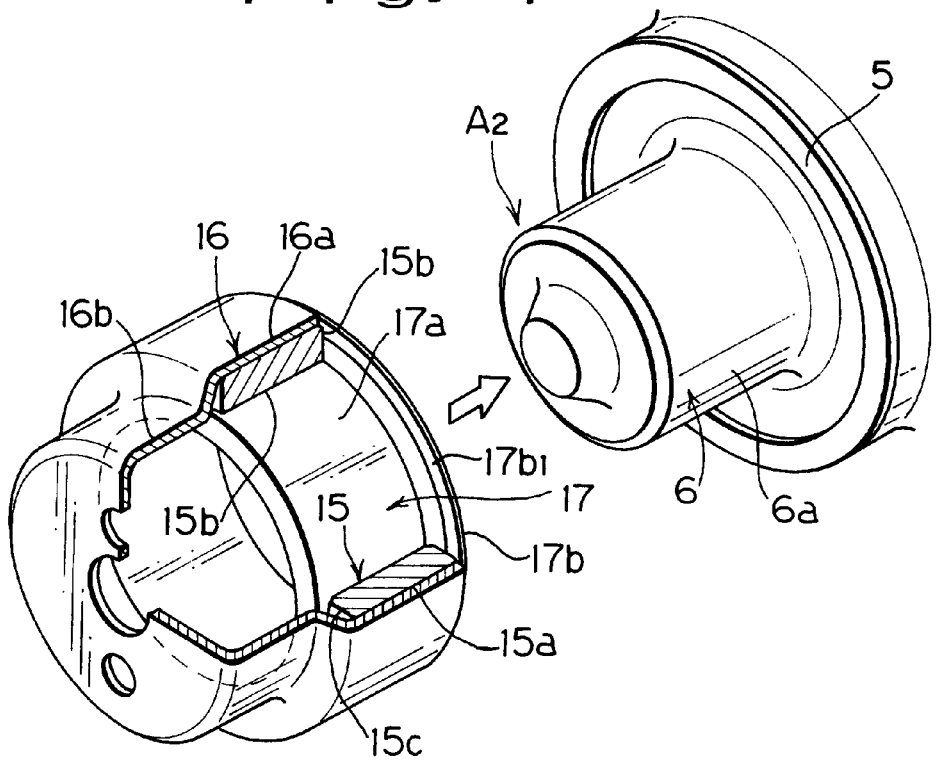
FIG. 4 is a partially cut-away perspective view of the magnet cup body and outer magnet.

The coupling partition wall portion $A_2$ is mounted facing the impeller chamber 1 of the housing main body portion $A_1$, and is a component that accommodates the impeller B together with the impeller chamber 1. The external shape of this coupling partition wall portion $A_2$ is substantially hat-shaped, and this coupling partition wall portion $A_2$ is constructed from a cover surface portion 5 which covers the impeller chamber 1, and a cylindrical accommodating portion 6 into which the inner magnet 12 of the impeller B can be loosely inserted (see FIG. 4).

A connecting portion 7 with a circular circumferential shape that can fit inside the inner circumferential surface 1*a* of the impeller chamber 1 is formed on the cover surface portion 5. A grooved ridge 7*a* into which a sealing member 8 such as an O-ring or the like can be inserted is formed in the connecting portion 7 so that the impeller chamber 1 can be formed into a waterproof structure with the outside of the pump via the sealing member 8 when the coupling partition wall portion $A_2$ is mounted in the housing main body portion $A_1$. It is desirable that the coupling wall partition portion $A_2$ be formed from a synthetic resin in order to allow the magnetic force from the outer magnet 12 (described later) to pass through with almost no attenuation.

Next, the impeller B is constructed from a vane portion 10, a magnet fastening portion 11, an inner magnet 12 and a shaft-supported member 13. The vane portion 10 is constructed from a plurality of vanes 10*a*, 10*a*, . . . ; the vane portion 10 and the abovementioned magnet fastening portion 11 are formed as an integral unit, and the inner magnet 12 is accommodated in and fastened to the magnet fastening portion 11. In actuality, the inner magnet 12 is accommodated in the magnet fastening portion 11 in a cast-in state using a synthetic resin (see FIG. 1).

The inner magnet 12 has a cylindrical shape, and the shaft-supported member 13 is passed through the central position of the inner magnet 12 with respect to the direction of the diameter of the inner magnet 12, along the axial direction of the inner magnet 12. This shaft-supported member 13 has a tubular shape, and is supported by the impeller shaft 2 disposed in the impeller chamber 1 of the abovementioned housing main body portion $A_1$, so that the impeller B is supported in the impeller chamber 1 in such a manner that the impeller is free to rotate (see FIG. 1).

Next, the outer magnet 15 has a cylindrical shape, and comprises an outer circumferential surface 15*a*, an inner circumferential surface 15*b* and two end surface portions 15*c*, 15*c* on both end portions with respect to the axial direction (see FIG. 5). The inner circumferential surface 15*b* allows the loose insertion of the outer circumferential surface portion 6*a* of the accommodating portion 6 of the coupling partition wall portion $A_2$. The magnet cup body 16 holds the outer magnet 15; this part has a circular cup shape, and is formed from a mounting portion 16*a* and a driven portion 16*b* (see FIG. 4).

The mounting portion 16*a* and driven portion 16*b* have different diameters, and a step is formed at the boundary of the two portions. The outer magnet 15 is mounted in the mounting portion 16*a* so that the outer circumferential surface 15*a* of the outer magnet 15 is surrounded by this mounting portion 16*a*. Furthermore, the driven portion 16*b* is a member which is attached to a rotating shaft or the like installed in the main body of the engine, or on which a rotation-transmitting member such as a chain sprocket or the like is mounted (see FIG. 1).

Figure 6:
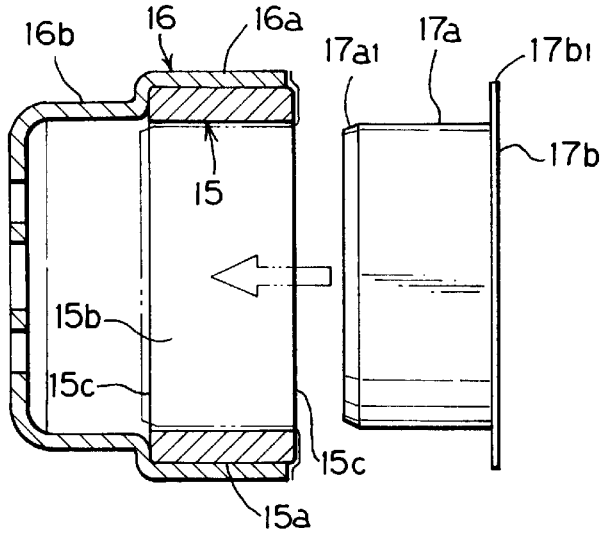
FIG. 6 is a sectional view showing the separated state of the magnet cup body and outer magnet.

Next, the covering member 17 is constructed from a cylindrical inner circumferential side covering portion 17*a*, and a flange-shaped flange-form portion 17*b* which is formed on one end of the inner circumferential side covering portion 17*a* with respect to the axial direction (see FIG. 5). The opposite end of the inner circumferential side covering portion 17*a* (in the axial direction) from the end on which the above-mentioned flange-form portion 17*b* is formed constitutes a guide end $17a_1$ which is formed by a reduction of area so that the diameter of this end is slightly smaller (see FIG. 6). Furthermore, the flange-form portion 17*b* has a thin annular disk shape, and an outer circumferential edge portion $17b_1$ which is dropped one level via a step portion is formed in the vicinity of the outer circumference of this flange-form portion 17*b*.

The covering member 17 covers and protects the inner circumferential surface 15*b* and one end surface portion 15*c* of the outer magnet 15; this covering member 17 is formed from a thin nonmagnetic metal material in order to reduce the attenuation of the magnetic force of the outer magnet 15 and the inner magnet 12. In concrete terms, a stainless steel material, aluminum alloy or the like is appropriate, and this member 17 is integrally molded by pressing.

The inner circumferential side covering portion 17*a* of the covering member 17 is inserted inside the inner circumferential surface 15*b* of the outer magnet 15. In this case, insertion inside the inner circumferential surface 15*b* is effected from the abovementioned guide end $17a_1$ which has been formed by a reduction in area so that the diameter of this guide end is slightly smaller; accordingly, the insertion operation is facilitated. Furthermore, the strength of the inner circumferential side covering portion 17*a* is slightly increased by the guide end $17a_1$, so that deformation is made less likely to occur.

Figure 7A:
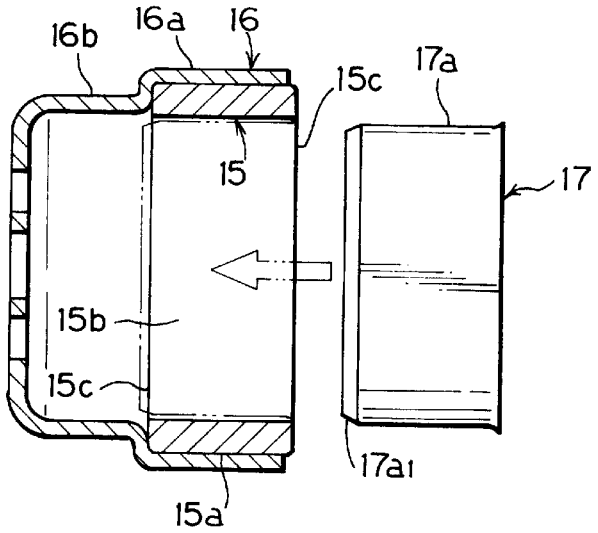
FIG. 7A is a sectional view showing the separated state of the magnet cup body and outer magnet.
Figure 7B:
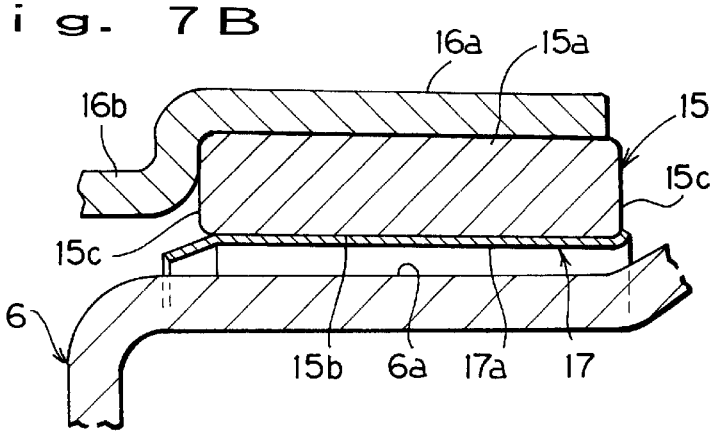
FIG. 7B is an enlarged sectional view of parts of the present invention.

Furthermore, the flange-form portion 17*b* has a shape that adheres more or less tightly to one end surface portion 15*c* of the outer magnet 15, and thus covers and protects this end surface portion 15*c*. Furthermore, the outer circumferential edge portion $17b_1$ of the flange-form portion 17*b* can cover the space between the end surface portion 15*c* of the outer magnet 15 and the open end of the magnet cup body 16. Moreover, an embodiment also exists in which a flange-form portion 17*b* is not formed on the covering member 17 (see FIG. 7A). In this embodiment, only the inner circumferential surface 15*b* of the outer magnet 15 is covered (see FIG. 7B).

As was described above, the impeller B is mounted in the pump housing A in a state in which the inner magnet 12 of the impeller B is accommodated inside the inner circumferential portion 6*b* of the accommodating portion 6 of the coupling partition wall portion $A_2$. Furthermore, the outside of the accommodating portion 6 is surrounded by the inner circumferential surface 15*b* of the outer magnet 15, so that the magnet cup body 16 that supports the abovementioned outer magnet 15 rotates at a high speed as a result of the transmission of rotation from the engine, and the rotation of the outer magnet 15 is transmitted to the inner magnet 12 via magnetic force, so that the inner magnet 12 rotates, thus causing the impeller B to rotate as well.

Thus, the present invention comprises a magnetic pump having a magnetic coupling structure in which an inner magnet 12 disposed on an impeller B is accommodated in a cylindrical accommodating portion 6 of the pump housing A, the outer circumferential surface 6*a* of the accommodating portion 6 is loosely inserted into the inner circumferential surface 15*b* of a cylindrical outer magnet 15 which is supported on its outer circumferential surface 15*a* by a magnet cup body 16, and which rotates together with the magnet cup body 16, and the impeller B rotates in accordance with the rotation of the outer magnet 15, wherein a cylindrical covering member 17 which covers the inner circumferential surface 15*b* of the outer magnet 15 is mounted on the outer magnet 15. Accordingly, even if the outer magnet 15 should separate from the magnet cup body 16, a deterioration in the pump function can be prevented. Furthermore, the structure is extremely simple, and assembly can be facilitated.

To describe the abovementioned effect in greater detail, the outer circumferential surface 15*a* of the outer magnet 15 is supported by the magnet cup body 16; furthermore, the inner circumferential surface 15*b* of the outer magnet 15 is protected by the covering member 17 in a tightly adhering state; accordingly, the outer magnet 15 is also protected by the covering member 17 against external factors such as abrupt temperature changes and vibration, so that the durability of the outer magnet can be improved.

Accordingly, practical use is possible even in harsh environments involving low temperatures, high temperatures, temperature changes, vibration and the like inside engines or the like. Furthermore, since the covering member 17 is merely mounted on the inner circumferential surface 15*b* of the outer magnet 15 in a tightly adhering state, the structure is extremely simple, and assembly is also simple.

Furthermore, the present invention comprises the magnetic pump as noted above, wherein a flange-form portion 17*b* which covers the end surface portion 15*c* of the outer magnet 15 in the axial direction is formed on the covering member 17. Accordingly, not only the inner circumferential surface 15*b* of the outer magnet 15, but also the end surface portion 15*c* in the axial direction can be covered by the flange-form portion 17*b,* so that the outer magnet 15 can be covered more or less completely, thus making it possible to handle harsh conditions in which even greater temperature differences, vibrations or the like occur.

Still furthermore, the present invention comprises the magnet pump as noted above, wherein the covering member 17 is formed from a nonmagnetic material. Accordingly, the clearance of the outer magnet 15 and inner magnet 12 in the magnetic coupling can be appropriately maintained, so that effects on the magnetic force can be reduced. Consequently, even if the magnetic force is blocked by the covering member 17, the attenuation of the magnetic force can be minimized, so that the required magnetic coupling performance can be obtained.

In addition, the present invention comprises the magnet pump as noted above, wherein the covering member is formed from a stainless steel material. Accordingly, strength and durability can be sufficiently guaranteed even in the case of an extremely thin covering member 17; furthermore, a covering member 17 can be obtained which allows sufficient passage of the magnetic force of the outer magnet 15.

Lastly, the present invention comprises a magnet pump in which the abovementioned covering member 17 is formed from a thin material. Accordingly, the inner circumferential side covering portion 17*a* of the covering member 17 and flange-form portion 17*b* can fit well against the inner circumferential surface 15*b* and end surface portion 15*c* of the outer magnet 15, so that a state of mutual tight adhesion can be obtained, thus tending to prevent looseness.

What is claimed is:

1. A magnetic pump having a magnetic coupling structure comprising:

an inner magnet disposed on an impeller and accommodated within a cylindrical accommodating portion of a housing, an outer circumferential surface of said accommodating portion being loosely inserted into an inner circumferential surface of an outer magnet that is supported on its outer circumferential surface by a magnet cup body, and that rotates together with said magnet cup body; and wherein said impeller rotates in accordance with a rotation of said outer magnet; and wherein said outer magnet has a shape of single cylinder, and wherein a cylindrical covering member covers the inner circumferential surface of said outer magnet, said covering member having a cylindrical inner circumferential side covering portion mounted in a tightly adhering state only on said inner circumferential surface of said outer magnet;

a flange-form portion formed on one end of said inner circumferential side covering portion in an axial direction thereof; and a guide end with a smaller diameter than said flange-form portion, said guide end being disposed in an axial direction thereof on an end of said inner circumferential side covering portion that is opposite to said one end on which the flange-form portion has been formed.

2. The magnetic pump according to claim 1, wherein said covering member comprises a thin material, and wherein said guide end of said covering member is formed by draw forming.

3. The magnetic pump according to claim 1, wherein said covering member is integrally formed by pressing from a thin stainless steel material.

* * * * *